United States Patent [19]

Amburgey

[11] Patent Number: 4,655,454

[45] Date of Patent: Apr. 7, 1987

[54] BOWLING BALL

[76] Inventor: Jay D. Amburgey, 1710 N. Dotsy, Odessa, Tex. 79761

[21] Appl. No.: 818,328

[22] Filed: Jan. 13, 1986

[51] Int. Cl.[4] ..... A63B 37/10

[52] U.S. Cl. ..... 273/63 E; 273/63 C

[58] Field of Search ..... 273/63 E, 63 R, 63 B, 273/63 C, 63 D, 63 F

[56] References Cited

U.S. PATENT DOCUMENTS

| | | | |
|---|---|---|---|
| 2,291,738 | 8/1942 | Luth et al. | 273/63 E |
| 3,441,274 | 4/1969 | Collins | 273/63 E |
| 4,121,828 | 10/1978 | Amburgey | 273/63 E |
| 4,183,527 | 1/1980 | Amburgey | 273/63 E |
| 4,268,034 | 5/1981 | MacDonald | 273/63 E |
| 4,320,899 | 5/1982 | Salvino | 273/63 E |

*Primary Examiner*—George J. Marlo

*Attorney, Agent, or Firm*—Roylance, Abrams, Berdo & Goodman

[57] ABSTRACT

A bowling ball having an outer shell and a core comprised of a main body and a plurality of weight blocks. The outer shell is of uniform thickness, completely encases the core and has an outer spherical surface. The main body and the weight blocks combine to form a solid sphere. The weight blocks are of the same size, shape and material and have first curved surfaces which form a part of the outer surface of the core and second surfaces directed to the center of the sphere. The weight blocks are symmetrical about center axes thereof and have a greater density than the main body. The first and second surfaces of the weight blocks join at an edge. The weight blocks diminish in cross section, transverse to their center axes, from the edges to the lowermost portions. The weight blocks form a cluster around a vertical axis extending outward from the geometric center of the ball. The center of gravity of the cluster of weight blocks and of each individual weight block is an equal distance from the geometric center of the ball. In other embodiments of this invention, the ball is comprised of a homogeneous material (except for the weight blocks) without an outer shell. The weight blocks are embedded with the ball and are designed as discussed above.

12 Claims, 6 Drawing Figures

BOWLING BALL

FIELD OF THE INVENTION

This invention relates to bowling balls. More particularly, this invention relates to bowling balls having weight blocks imbedded in the interior thereof to compensate for the removal of material for finger and thumb holes.

BACKGROUND OF THE INVENTION

Bowling balls have to be within a standard size and weight range to comply with American Bowling Congress requirements. Only balls that comply with these requirements may be used in American Bowling Congress sanctioned play. The standard size requirements are that the balls must have a circumference between 26.704" and 27.002" and a diameter between 8.500" and 8.595". These standard balls must also not weigh more than 16 pounds, and are generally between 10–16 pounds.

Such balls are usually comprised of a spherical core formed of a homogeneous material encased by a continuous outer shell. The outer shell has a spherical exterior surface which is the rolling surface of the ball.

Each ball has two or more finger holes drilled therein. These finger holes are usually drilled into the ball after the ball has been manufactured. In custom made balls, the finger holes are positioned, and drilled at various angles, depending on the various hand size of, and finger spacing desired by, an individual bowler.

However, when these finger holes are drilled, the finger holes will tend to imbalance the ball and shift the center of gravity of the ball away from the geometric center of the ball in the direction opposite the finger holes. This imbalance will exert a force on the ball as it rolls down a bowling lane.

Bowling balls have been developed which have weight blocks imbedded in the outer edge of the core of the balls. These weight blocks are comprised of a material more dense than the remaining material of the ball. The finger holes are usually positioned adjacent the weight blocks, such that the weight blocks compensate for the loss of material when the finger holes are drilled.

The location of these weight blocks is critical since it is an American Bowling Congress requirement that the name plate or logo of a bowling ball must be placed over the heaviest portion of the undrilled ball. In addition, the center of the heaviest portion must be indicated by a mark, or a letter locator contained in the trademark, logo, etc. of the ball. In all current balls, this "heaviest portion" is determined by flotation tests, which are well known in the industry.

Moreover, it is a further American Bowling Congress requirement that each ball must pass a uniform weight test, which involves dividing the ball into six "sides" or three sets of hemispheres. The first set of sides is the top side including the finger holes and the bottom side (or hemisphere) opposite the finger holes. The second set of sides is the side left of the finger holes and the side right of the finger holes. The third set of sides is the side in front of the finger holes and the side in back of the finger holes. For balls weighing between 10–16 pounds, the weight of the top and bottom sides may only vary by three ounces, and the weight of the left and right sides, and of the front and back sides, may only vary by one ounce. Therefore, these weight blocks have to be designed and positioned to comply with these further stringent requirements.

Examples of prior bowling balls which have weight blocks are disclosed in U.S. Pat. No. 4,121,828 issued to the inventor of this invention on Oct. 24, 1978 and entitled "Bowling Ball", U.S. Pat. No. 4,183,527 issued to the inventor of this invention on Jan. 15, 1980 and entitled "Gyrostablized Bowling Ball" and U.S. Pat. No. 4,320,899 issued to Carmen M. Salvino on May 23, 1982 and entitled "Bowling Ball". However, most of the weight blocks disclosed in these patents have (1) a curved inner surface which forms an arc of a circle having a center the same as the geometric center of the ball, (2) have an inner surface which forms a tangent of a circle having the geometric center of the ball as its center and/or (3) are one piece inserts. In the balls disclosed in these prior patents, the placement of the finger holes is critical to the optimum performance of the balls. Therefore, great care must be taken in the positioning of the finger holes.

However, it is difficult to duplicate the finger holes in the same spatial relationship to the weight block(s) in the balls disclosed by these patents. Therefore, it is virtually impossible to duplicate the inertial guidance of these balls.

The bowling balls according to this invention solve this problem since the center of gravity of the balls is controlled closer (relative to the prior balls) to the geometric center of the balls. It is therefore possible to duplicate the inertial guidance of a ball in a second ball.

Therefore, there is a need in the art for a bowling ball wherein the positioning of the finger holes relative to the weight blocks may be duplicated so that the duplicate ball will have the same dynamic characteristics as the first ball. In addition, there is always a need in the bowling industry for a ball which provides extra striking power on the pins due to the internal construction of the ball. This invention addresses these needs in the art, along with other needs which will become apparent to those skilled in the art once given this disclosure.

SUMMARY OF THE INVENTION

Generally speaking, this invention provides a bowling ball comprising an outer shell of uniform thickness and having an outer spherical surface; and a core including a main body and a plurality of weight blocks, the main body and the weight blocks combining to form a solid sphere, the weight blocks being of uniform size and shape, each of the weight blocks being symmetrical about a center axis thereof; the shell completely encasing the core; the weight blocks having top surfaces and second surfaces directed to the center of the sphere, said first and second surfaces connecting and forming an edge; the weight blocks having a greater density than the main body; wherein the largest cross sectional area of said blocks, perpendicular to the center axes, is located at the edges formed by the first and second surfaces.

In another embodiment of this invention, the top surfaces of the weight blocks are first curved surfaces forming in part the outer surface of the core.

In yet other embodiments of this invention, the cross sectional area of the weight blocks, perpendicular to the center axis, continually decreases from the edges of the weight blocks to the lowermost tips of the weight blocks.

In further embodiments of this invention, the second surfaces include a curved portion, the tangents of which form an acute angle with a line from the geometric center of the ball to the center of gravity of the weight blocks.

In yet other embodiments, the second surfaces are continuous spherical portions.

In other embodiments of this invention, the plurality of weight blocks may comprise three spaced weight blocks forming a cluster. The cluster may have a center of gravity located between the three weight blocks. These weight blocks may be positioned within the core such that lines passing through each of the centers of the weight blocks and the geometric center of the ball form equal angles with a line passing from the center of gravity of the cluster of weight blocks to the geometric center of the ball.

These weight blocks may also be positioned such that the center of gravity of the cluster and of each of the individual weight blocks is located an equal distance from the geometric center of the ball. Moreover, lines connecting the centers of the weight blocks may form an equilateral triangle.

In some embodiments of this invention, the weight blocks are spherical portions of homogeneous material comprising less than a hemisphere.

In other embodiments of this invention, the balls may be manufactured without outer shells, that is, the balls may be comprised of a homogeneous material having the weight blocks embedded therein below the exterior surfaces of the balls.

Bowling balls according to this invention have many advantages over previously known bowling balls. First, once a bowler has used a ball according this invention and has become accustomed to it, it can be easily duplicated if the first ball becomes damaged or worn. This is because the weight blocks are uniform and evenly balanced around an axis of the ball extending from the center of gravity of the cluster of weight blocks to the geometric center of the ball. Drill lines are formed by connecting the centers of gravity of the weight blocks. The finger holes are positioned along one of these drill lines or on a line parallel to one of these drill lines. The location of one set of holes can be easily duplicated by measuring the distance from the finger holes to the drill line the holes are parallel with, and then duplicating this measurement with respect to any of the drill lines of a second ball according to this invention. Thus, it is now possible to duplicate a bowling ball such that a bowler will get the same hook, pin action, lane position and hitting power with a duplicate ball. This will also result in a bowler not having to change his timing when he or she changes bowling balls.

Another advantage is that there is no need for a flotation test to determine the projected center of gravity. The projected center of gravity of this ball will always be readily determinable as long as the finger holes are placed within the area formed by the drill lines, as discussed below.

Moreover, the bowling balls according to this invention control the rate of projection of the actual center of gravity of the ball as it is rolled down a lane. Tests with prior balls show that the rate of projection may vary up to four to one. In the bowling balls according to this invention, the rate of projection of the actual center of gravity of the ball is only one to one.

Also, the rolling planes of the actual centers of gravity of the balls according to this invention are closer to the rolling planes of the geometric centers of the balls than with other balls. This results in a ball which is more consistent in its movement as it is rolled down a lane and also a ball that has greater hitting power when it reaches the pins.

Another advantage is that each weight block creates its own gyroscopic plane as the ball rolls. Each weight block is generating its own independent force which is released when it strikes the pins to increase the hitting power of the ball, therefore resulting in greater pin action.

BRIEF DESCRIPTION OF THE DRAWINGS

Certain embodiments of this invention are illustrated in the Figures, wherein.

DETAILED DESCRIPTION OF THE DRAWINGS

Figure 1:
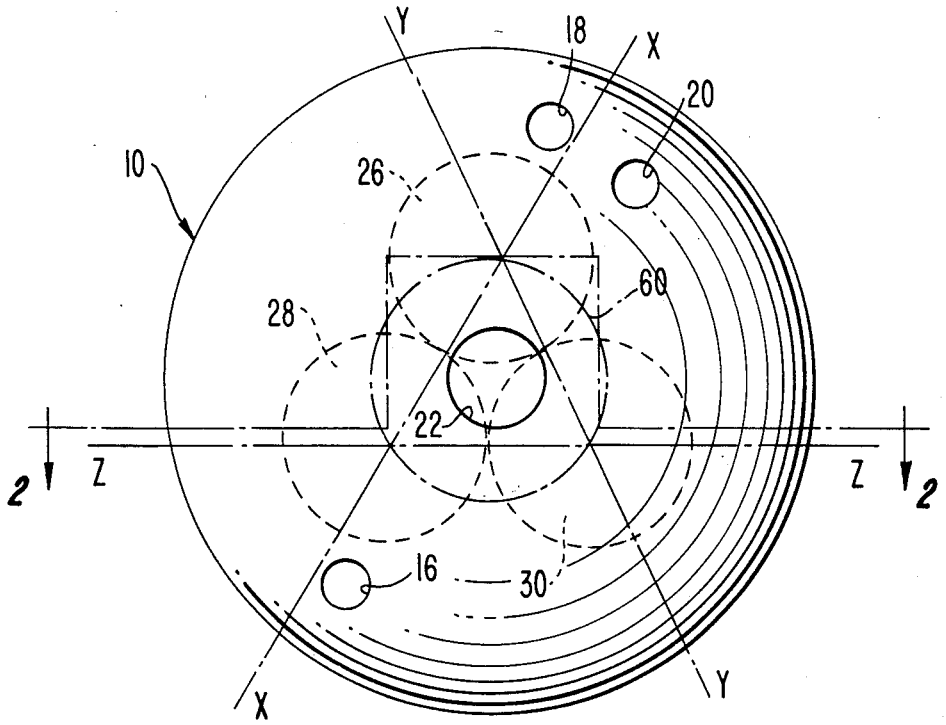
FIG. 1 is a top plan view of a bowling ball according to this invention.
Figure 2:
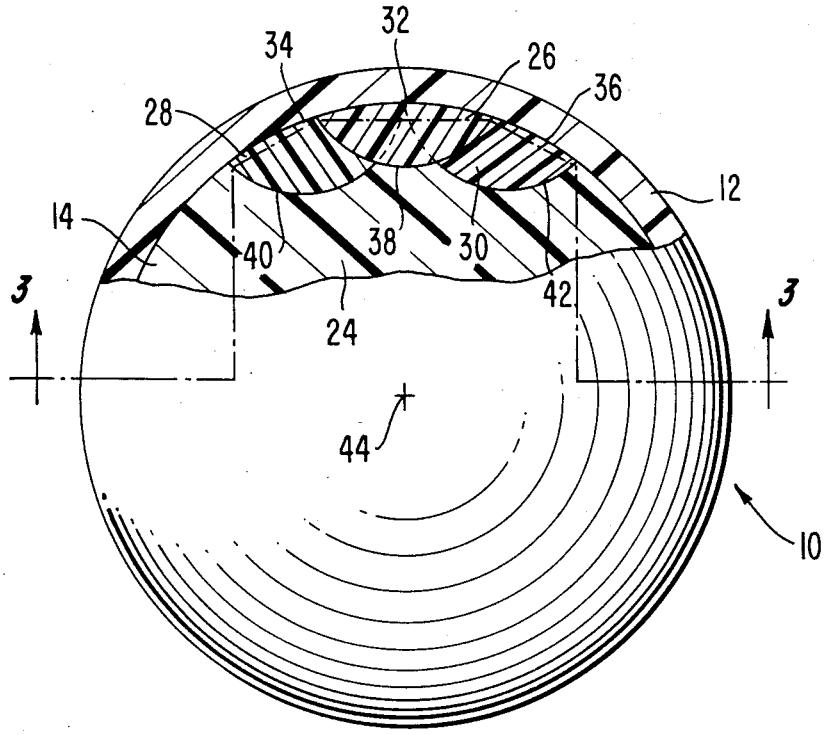
FIG. 2 is a side elevational cross-section view taken along line 2—2 of FIG. 1.
Figure 3:
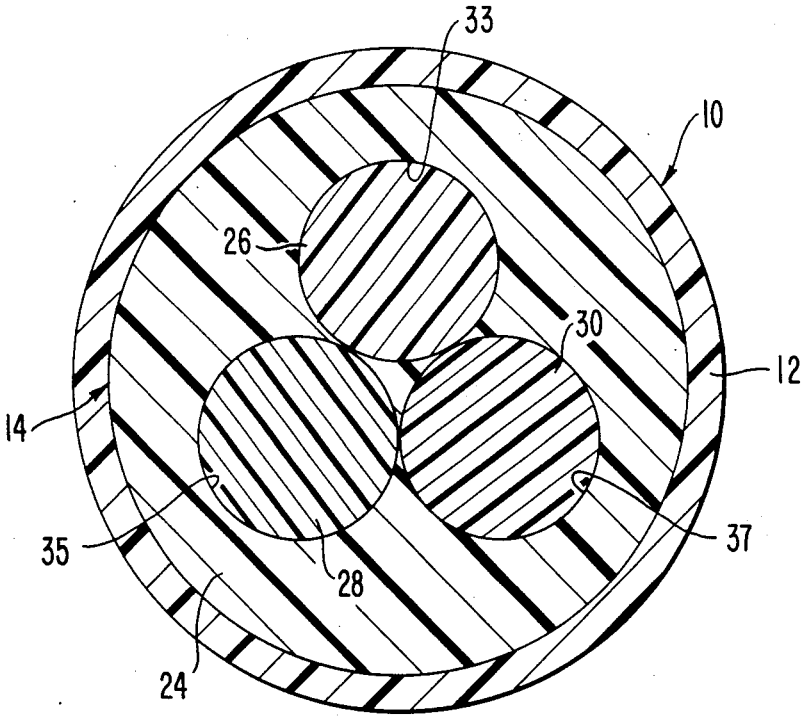
FIG. 3 is a bottom cross-sectional view taken along line 3—3 of FIG. 2.

Referring to the Figures, in particular FIGS. 1–3, an embodiment of this invention, bowling ball 10, is illustrated. Ball 10 has an outer shell 12 and a core 14. Outer shell 12 completely encases core 14.

Outer shell 12 is of a material and size well known in the industry and thus its specific features will not be described herein. Shell 12 may be comprised of one or more layers of material as desired. The important feature is that shell 12 has an outer spherical surface which interfaces with the bowling lane when ball 10 is being rolled.

Shell 12 has finger holes 16, 18 and 20 which are of a size and relative postion depending on the needs of the individual bowler. As discussed above, holes 16, 18 and 20 are placed depending on the size of the bowler's hand and the finger spacing the bowler is comfortable with. Holes 16, 18 and 20 may be drilled at various angles, depending on these same factors. In addition, name plate indicia (represented generically by circle 22, see FIG. 1) is placed on ball 10 at the point on shell 12 which is on a line from the geometric center of the ball through the center of gravity of the heaviest portion of the ball.

Core 14 is comprised of a main body portion 24 and, in this embodiment, three weight blocks 26, 28 and 30. In other embodiments, two or more weight blocks may be employed. Main body 24 and weight blocks 26, 28 and 30 combine to form a solid sphere which is completely encased by outer shell 12.

The material which main body 24 may be comprised of is well known in the art and thus not discussed in detail herein. The same is true for weight blocks 26, 28 and 30, except that weight blocks 26, 28 and 30 should be comprised of a material more dense than the material which comprises main body portion 24.

In the embodiment illustrated in FIGS. 1–3, weight blocks 26, 28 and 30 are identical, forming a portion of a sphere which is less than a hemisphere. In other embodiments, the weight blocks may comprise a complete hemisphere or any portion of a sphere less than a hemisphere.

Each block 26, 28, and 30 has an upper curved surface, upper curved surfaces 32, 34 and 36, respectively, and a lower curved surface, lower curved surfaces 38, 40 and 42, respectively. In other embodiments, surfaces 32, 34 and 36 may be flat. Lower curved surfaces 38, 40 and 42 intersect with upper curved surfaces 32, 34 and 36 to form edges 33, 35 and 37, respectively. Upper curved surfaces 32, 34 and 36 form a portion of the outer surface of the sphere formed by core 14. Lower curved surfaces 38, 40 and 42 are directed towards the geometric center 44 of ball 10. "Directed towards" as employed herein means that the cross sectional area, transverse to the center axis, of the weight blocks 26, 28 and 30 decreases continuously from edges 33, 35 and 37 to the lower most point thereof. Lower curved surfaces 38, 40 and 42 are convex from the reference point of the geometric center 44 of ball 10.

The dimensions of weight blocks 26, 28 and 30 are that the blocks have a approximate diameter at edges 33, 35 and 37 of between 1–3 inches and an approximate height of 1⅝–1⅝ inches. Dimensions depending on the density of the weight block material.

Weight blocks 26, 28 and 30 form a cluster. The centers of gravity of blocks 26, 28 and 30, when connected by arcs, lie in circle 60 (see FIG. 1). Circle 60 may have a radius of 1–3 inches.

In other embodiments, the cluster can include two or more weight blocks, as desired. The center of gravity of the weight blocks is located between the three weight blocks, equidistant from the center of gravity of each of the blocks. In addition, the distance between the center of gravity of the cluster and the geometric center of the balls is equal to the distance from the geometric center of ball 10 to the center of gravity of each of the individual blocks 26, 28 and 30.

This embodiment has the advantages over the previously known balls discussed above. The center of gravity of a ball of homogeneous material or of a ball formed of uniform radial layers of homogeneous material is the geometric center of the ball. However, if something is done to alter this perfect sphere (such as the drilling of finger holes therein), the center of gravity shifts from the geometric center of the ball. This new center of gravity is called the projected center of gravity. When finger holes are drilled into a ball of homogeneous material or formed of uniform layers, then the projected center of gravity will move from the geometric center of the ball in the opposite direction from the drilled holes. The employment of weight blocks 26, 28 and 30 retain the projected center of gravity close to the geometric center of the ball after the finger holes are drilled into the ball.

This is advantageous since the retention of the projected center of gravity close to the geometric center of the ball will result in a more "true" roll of the ball (without "wobble") since the rolling plane of the projected center of gravity remains close to the geometric center of the ball.

Moreover, each weight block 26, 28 and 30 is balanced about its own center axis. This increases the striking force of ball 10 when it strikes the bowling pins.

Ball 10 is manufactured without finger holes 16, 18 and 20 drilled therein. Preferably, finger holes 16, 18 and 20 are placed in the ball by the retailer of the ball to fit the specific hand measurements of the ultimate user of the ball. The retailer is guided as to where to place the finger holes based on reference or drill lines X, Y, and Z shown in FIG. 1. Lines X, Y and Z are the drill lines along which the finger holes preferably are drilled.

Taking drill line X as an example, the finger holes can be placed on line X or on any line 1) parallel to line Y and 2) which has a portion within the triangle formed by lines X, Y and Z. That is, the thumb hole can be drilled directly on line X or on any line parallel to line X and within this triangle, and finger holes can be drilled an equal distance on each side of line X or on each side of the second line (in the three hole models). The same is true of lines Y and Z; the holes can be drilled on lines Y and Z or on lines parallel to lines Y and Z which have a portion within the triangle formed by lines X, Y and Z.

Ball 10 is unique in that sets of finger holes drilled along any of the drill lines X, Y and Z, or on lines parallel to and equally spaced from lines X, Y and Z will have the exact same spatial relationship with respect to weight blocks 16, 18 and 20. Thus, no matter what drill line the holes are oriented with, the ball will have the same characteristics as a ball having its finger holes drilled in the same spatial relationship to the other two drill lines.

Thus, once a bowler becomes accustomed to a ball according to this invention, the ball can be easily duplicated by placing the finger holes in the same spatial relationship with any of the drill lines X, Y and Z.

The placement of the holes relative to one of drill lines X, Y and Z will determine the offset between the bowler's hand and the weight blocks.

Drill lines X, Y and Z are not actual lines on a ball, but are lines which can be devised from the name plate of the ball.

Figure 4:
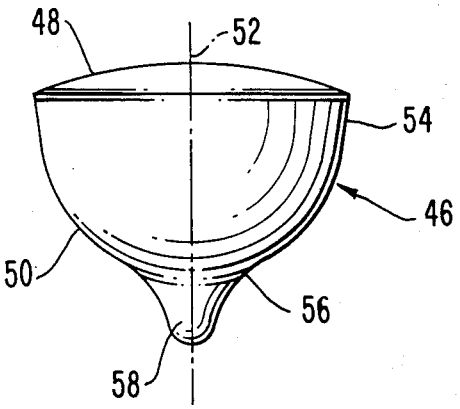
FIG. 4 is a side view of another weight block which can be employed in the practice of this invention.

FIG. 4 illustrates another embodiment of weight blocks which can be employed in the practice of this invention, weight block 46. Weight block 46 is symmetrical about center axis 52 and has upper curved surface 48, which is similar to upper curved surfaces 32, 34 and 36 in that it forms a portion of the exterior spherical surface of the core of a bowling ball. Weight block 46 also includes lower curved surface 50 formed of various arcs having various radii. In this embodiment, lower curved surface 50 is comprised of upper curved portion 54, lower curved portion 56 and tip 58. Curved portions 54 and 56 are reversely curved, that is the centers of their arcs are on opposite sides of surface 50.

Lower curved surface 50 can be of any shape and can be formed of any number of curved portions. The critical design element is that the widest cross section of the weight block must be located at the junction of the upper and lower curved surfaces.

Figure 5:
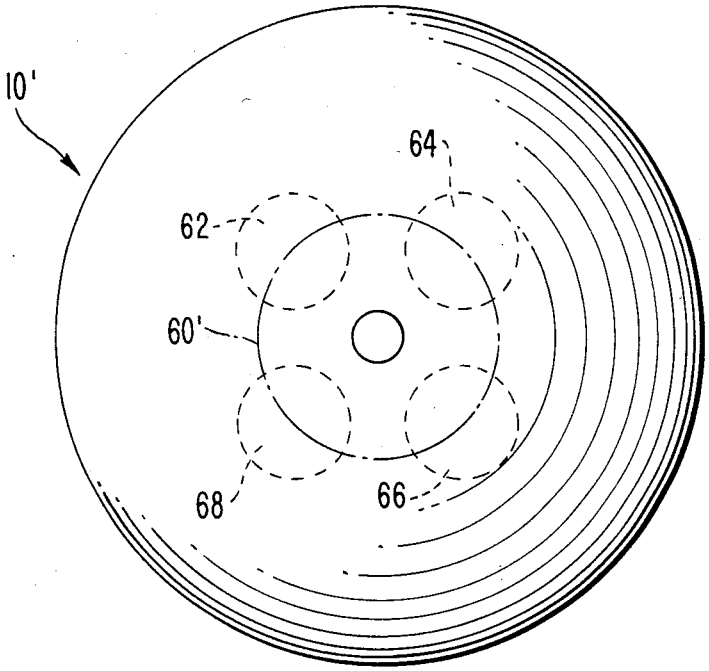
FIG. 5 is a top view of an embodiment of this invention including four weight blocks.

FIG. 5 illustrates another embodiment of this invention, ball 10', having four weight blocks 62, 64, 66 and 68. The centers of gravities of these weight blocks lie on circle 60'.

Figure 6:
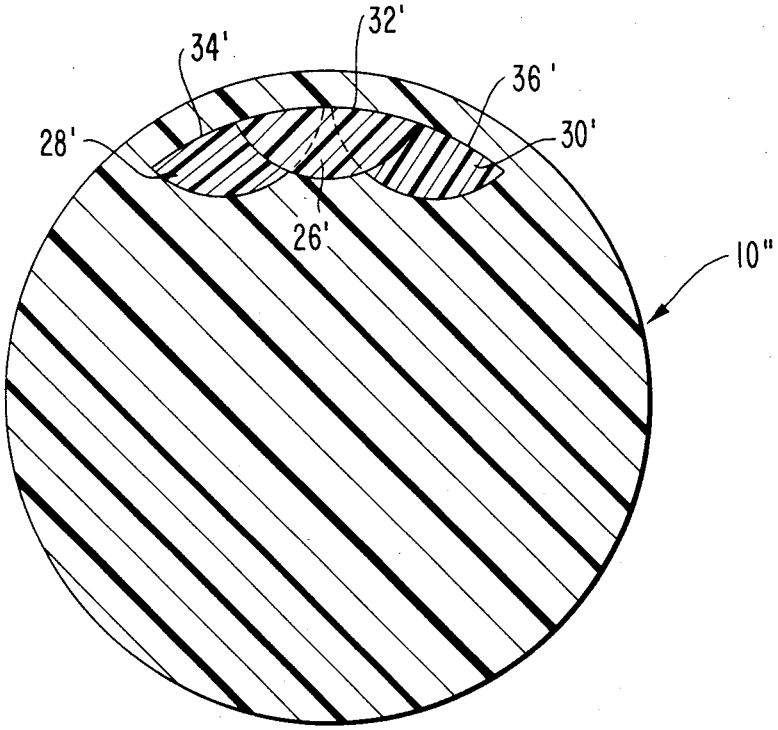
FIG. 6 is a side cross sectional view illustrating a ball according to this invention wherein the ball is comprised of a homogeneous material (except for the weight blocks).

FIG. 6 illustrates yet another embodiment of this invention, ball 10''. Ball'' is comprised of a single material of uniform density, except for weight blocks 26', 28' and 30'. Weight blocks 26', 28' and 30' are of the same shape and size as weight blocks 26, 28 and 30 and are embedded in the interior of ball 10''. The upper curved surfaces 32', 34' and 36' form a partial arc of a circle having the geometric center of ball 10'' as its center. The radius of this circle is less than the radius of ball 10'' such that surfaces 32', 34' and 36' are within ball 10''.

Surfaces 32', 34' and 36' may be spaced anywhere in the upper ½ of the hemisphere which forms ½ of ball 10''.

Once given this disclosure, other embodiments, modifications and improvements will become apparent to those skilled in the art. Such other embodiments, improvements and modifications are considered to be within the scope of this invention as defined by the following claims.

What is claimed is:

1. A bowling ball comprising:

an outer shell of uniform thickness and having an outer spherical surface; and a core including a main body and a plurality of weight blocks, said main body and said weight blocks combining to form a solid sphere, said weight blocks being of a uniform size and shape, each of said weight blocks being symmetrical about a center axis thereof, said center axes extending through the center of the ball;

said shell completely encasing said core;

each of said weight blocks having an upper curved surface, said upper curved surfaces having a constant radius from the center of the ball;

each of said weight blocks having a lower surface, said upper and lower surfaces intersecting to form an edge on each said weight block, said lower surfaces being closest to the center of the ball along said center axes, the distance from the center of the ball to the lower surfaces continually increasing from said center axes to said edges;

said weight blocks having a greater density than said main body;

wherein the largest cross sectional area of said blocks perpendicular to said center axes is located at said edges.

2. A bowling ball according to claim 1 wherein said upper surfaces form in part the outer surface of said core.

3. A bowling ball according to claim 2 wherein each of said lower surfaces includes a curved portion.

4. A bowling ball according to claim 3 wherein each of said lower surfaces is a continuous spherical surface.

5. A bowling ball according to claim 1 wherein said plurality of weight blocks comprises three spaced weight blocks forming a cluster;

said cluster of weight blocks has a center of gravity;

wherein lines passing through each of the centers of said weight blocks and said geometric center of said ball form equal angles with a line passing from the center of gravity of said cluster of said weight blocks to said geometric center of said ball.

6. A bowling ball according to claim 5 wherein the center of gravity of said cluster and of each of said weight blocks is located an equal distance from the geometric center of said ball.

7. A bowling ball according to claim 5 wherein lines connecting the centers of said weight blocks form an equilateral triangle.

8. A bowling ball according to claim 5 wherein said weight blocks are spherical portions comprising less than a hemisphere.

9. A bowling ball according to claim 1 wherein said lower surfaces are defined by two or more curves of different radii.

10. A bowling ball according to claim 9 wherein at least two of said curves are of reverse curvature.

11. A bowling ball comprising:

a main body of a homogeneous material and having an outer spherical surface;

a plurality of weight blocks, said weight blocks being embedded within said main body;

said weight blocks being of a uniform shape and size, each of said weight blocks being symmetrical about a center axis thereof, each of said center axes passing through the center of said ball;

each of said weight blocks having an upper curved surface which is convex with respect to the center of said ball;

each of said weight blocks having a lower surface, said upper and lower surfaces intersecting to form a continuous edge on each of said weight blocks, said lower surfaces being of a shape such that the distance from the center of the ball to each of said lower surfaces is shortest along said center axes and increases continuously to said edges;

said weight blocks having a greater density than said main body.

12. A bowling ball according to claim 11 wherein said top surfaces form a partial sphere having the geometric center of said ball as its center.

* * * * *